US010563462B2

(12) United States Patent
Ahonen

(10) Patent No.: US 10,563,462 B2
(45) Date of Patent: Feb. 18, 2020

(54) DRILLING DEVICE

(71) Applicant: Mincon Nordic Oy, Lempäälä (FI)

(72) Inventor: Jukka Ahonen, Lempäälä (FI)

(73) Assignee: MINCON NORDIC OY, Lempäälä (FI)

( * ) Notice: Subject to any disclaimer, the term of this patent is extended or adjusted under 35 U.S.C. 154(b) by 0 days.

(21) Appl. No.: 15/759,412

(22) PCT Filed: Sep. 12, 2016

(86) PCT No.: PCT/FI2016/050630
§ 371 (c)(1),
(2) Date: Mar. 12, 2018

(87) PCT Pub. No.: WO2017/046449
PCT Pub. Date: Mar. 23, 2017

(65) Prior Publication Data

US 2018/0179824 A1 Jun. 28, 2018

(30) Foreign Application Priority Data

Sep. 14, 2015 (FI) ..... 20150256

(51) Int. Cl.
*E21B 10/32* (2006.01)
*E21B 7/20* (2006.01)
*E21B 10/66* (2006.01)

(52) U.S. Cl.
CPC ..... *E21B 10/32* (2013.01); *E21B 7/20* (2013.01); *E21B 10/66* (2013.01)

(58) Field of Classification Search
CPC ..... E21B 10/32; E21B 10/66; E21B 7/20
See application file for complete search history.

(56) References Cited

U.S. PATENT DOCUMENTS 2,982,366 A 5/1961 Camp et al.
5,139,099 A 8/1992 Hayashi et al.
(Continued)

FOREIGN PATENT DOCUMENTS

AU 2014231909 A1 9/2015
CN 1179113 C 12/2004
(Continued)

OTHER PUBLICATIONS

International Search Report (PCT/ISA/210) dated Dec. 7, 2016, by the Finnish Patent Office as the International Searching Authority for International Application No. PCT/FI2016/050630.
(Continued)

*Primary Examiner* — Nicole Coy
*Assistant Examiner* — Yanick A Akaragwe
(74) *Attorney, Agent, or Firm* — Buchanan Ingersoll & Rooney PC

(57) ABSTRACT

A drilling device for drilling a hole in the ground and/or rock and having in its drilling head a plurality of drilling wing bits arranged at equal distribution with their mutual position being adjustable such that the wing bits are located within a minimum diameter dimension and, on the other hand, adjustable such that they are located to drill a hole with a maximum size diameter and that the drilling device is arranged to pull, during drilling, a protective pipe into the hole at least when drilling the hole in the ground. An outer circumference of the wing bits includes a circumferential groove arranged to receive a ring belonging to a front part of the protective pipe, to an inner surface thereof, when the wing bits are adjusted to a diameter size substantially larger than the minimum diameter dimension in order to pull the protective pipe via the wing bits.

14 Claims, 4 Drawing Sheets

(56) References Cited

U.S. PATENT DOCUMENTS

Figure 1:
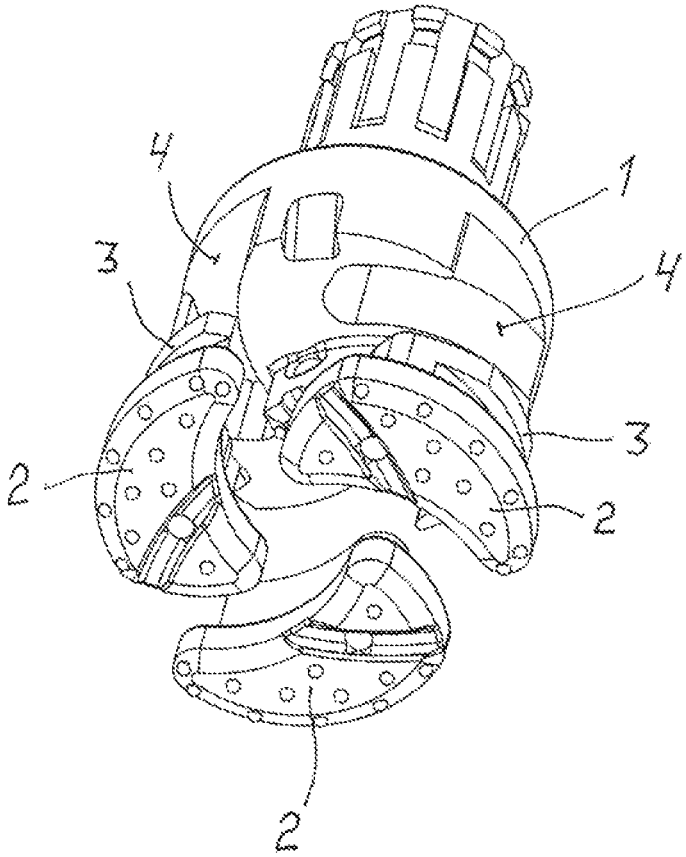

| | | | | |
|---|---|---|---|---|
| 5,957,224 | A | 9/1999 | Ilomäki | |
| 5,975,222 | A | 11/1999 | Holte | |
| 8,104,551 | B2 | 1/2012 | Nakamura | |
| 9,869,134 | B2 | 1/2018 | Nakamura et al. | |
| 10,024,108 | B2 * | 7/2018 | Gylling | E21B 10/32 |
| 2010/0236831 | A1 | 9/2010 | Nakamura | |
| 2016/0002983 | A1 | 1/2016 | Nakamura et al. | |
| 2016/0281435 | A1 | 9/2016 | Gylling | |
| 2018/0023349 | A1 * | 1/2018 | Gylling | E21B 7/20 175/385 |

FOREIGN PATENT DOCUMENTS

| | | | |
|---|---|---|---|
| CN | 101772616 | A | 7/2010 |
| EP | 0 429 649 | A1 | 6/1991 |
| EP | 0429649 | A1 | 6/1991 |
| EP | 1837481 | A1 | 9/2007 |
| FI | 96356 | B | 2/1996 |
| FI | 124451 | B | 9/2014 |
| JP | 10-140959 | A | 5/1998 |
| JP | 11-36770 | A | 2/1999 |
| JP | 11-71981 | A | 3/1999 |
| JP | 2000-104475 | A | 4/2000 |
| JP | 2001-082084 | A | 3/2001 |
| JP | 2001-323766 | A | 11/2001 |
| KR | 20080103666 | A | 11/2008 |
| WO | WO 95/34740 | A1 | 12/1995 |
| WO | 2015059347 | A1 | 4/2015 |

OTHER PUBLICATIONS

Written Opinion (PCT/ISA/237) dated Dec. 7, 2016; by the Finnish Patent Office as the International Searching Authority for International Application No. PCT/FI2016/050630.

Search Report dated May 12, 2016, by the Finnish Patent Office for Application No. 20150256.

Notification of the First Office Action dated Jan. 28, 2019, by the Chinese Patent Office in corresponding Chinese Patent Application No. 201680060284.0, and an English Translation of the Office Action. (15 pages).

The Partial Supplementary European Search Report dated Mar. 22, 2019, by the European Patent Office in corresponding European Application No. 16845780.2. (16 pages).

The extended European Search Report dated Jul. 19, 2019, by the European Patent Office in corresponding European Application No. 16845780.2. (15 pages).

Office Action (Notification of the Reasons for Rejection) dated Jun. 21, 2019, by the Korean Patent Office in corresponding Korean Patent Application No. 10-2018-7010003, and an English Translation of the Office Action. (14 pages).

* cited by examiner

SECTION A

DETAIL D

SECTION B

DRILLING DEVICE

The invention relates to a drilling device for drilling a hole in the ground and/or rock and having in its drilling head a plurality of drilling wing bits arranged at equal distribution with their mutual position being adjustable such that said wing bits are located within a minimum diameter dimension and, on the other hand, adjustable such that they are located to drill a hole with a maximum size diameter and that the drilling device is arranged to pull, during drilling, a protective pipe into the hole at least when drilling the hole in the ground.

A process is previously known in drilling devices, such as in drilling devices provided with extendable wing bits as well, of pulling a protective pipe into a hole during drilling. In these, the point of pulling of the protective pipe is placed in a cylindrical body of a pilot bit, the point being located clearly farther back than the wing bits. The cylindrical body of the pilot bit has either a groove or a projecting ring encircling the body of the pilot bit. A front part of the protective pipe is correspondingly provided with a ring to be received in this groove or a groove receiving such a projecting ring. In these cases, the difficulty has been how to detach the protective pipe from the pilot bit when drilling is to be continued in a forthcoming rock section without pulling the protective pipe along. A further aim is also to pull up the pilot bit and the wing bits, retracted, through the protective pipe out of the hole after drilling. Between the protective pipe and the pilot bit, a manner of connection known for such cases is a bayonet connection, disclosed, e.g. in Finnish Patent No. FI-96356 wherein such a connection is applied between a pilot bit and a ring bit. A drawback of such a connection is that it requires a disadvantageously vast diameter difference between the protective pipe and the cylindrical part of the pilot bit.

In order to eliminate these drawbacks, a novel drilling device is provided which enables an unexpected improvement over the prior art to be achieved. The drilling device according to the invention is characterized in that an outer circumference of said wing bits includes a circumferential groove arranged to receive a ring belonging to a front part of the protective pipe, to an inner surface thereof, when said wing bits are adjusted to a diameter size substantially larger than the minimum diameter dimension in order to pull the protective pipe by means of said wing bits.

An advantage of the invention is that it enables a uniform ring encircling the inner circumference of the protective pipe to be used in the front part of the protective pipe for transmitting a pulling force, thus enabling the dimensions of said ring to be decreased. The diameter of the protective pipe no longer depends on the diameter of the cylindrical part of the pilot bit, but on the position of an outer edge of the body of the wing bits in an extended state. The front part of the protective pipe is only provided with a relatively flat ring so as to reduce the inner diameter of the protective pipe, which is important since the pilot bit and the wing bits of the drilling device, retracted, should be able to be drawn through the protective pipe in each direction. Locking of the protective pipe to the drilling device by a locking manner allowing rotation takes place easily when the grooves provided in the bodies of the extending wing bits are arranged to meet said ring of the protective pipe.

Further, the drilling device according to the invention enables drilling with the wing bits in both extended and retracted positions, the rotating direction of the drilling device then being reverse to the previous one. When drilling with the protective pipe, a larger hole is drilled, and when drilling without a protective pipe, a smaller hole is drilled, with the wing bits retracted. In both cases, flushing of a drilling surface is arranged reliably but partly via different channels. When drilling without a protective pipe, a hole smaller than the outer diameter of the protective pipe is then drilled, in which case the protective pipe does not in a vertical hole fall on the bottom of the hole. In this case, either, no soil material will fall on the bottom of the hole from outside the protective pipe.

Figure 2:
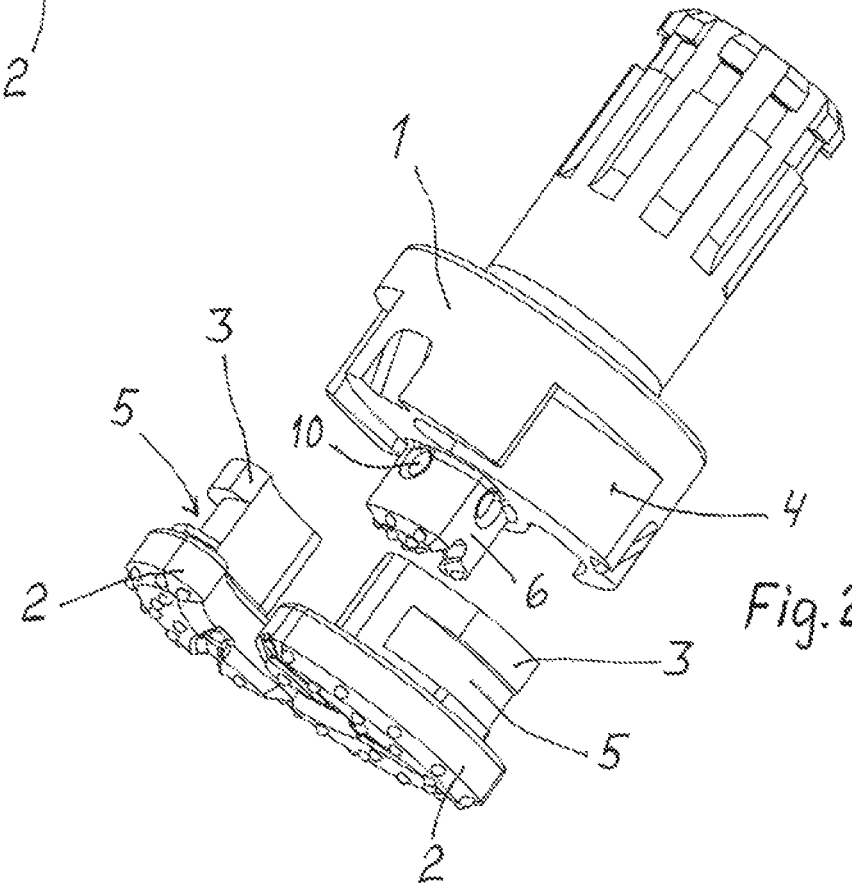
Figure 3:
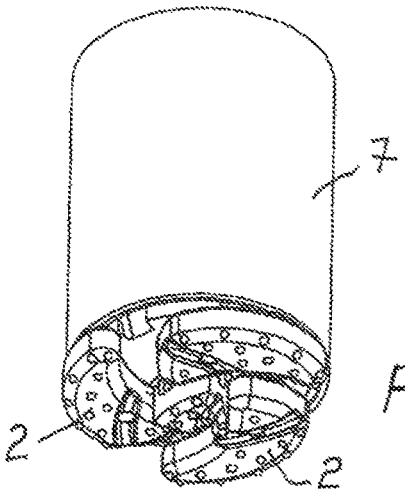
Figure 5:
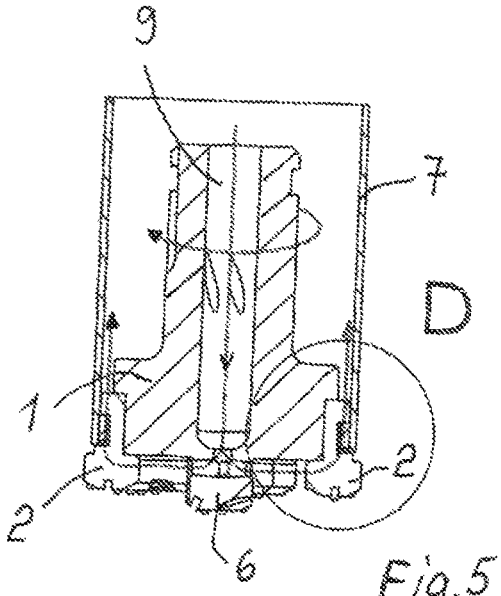
Figure 4:
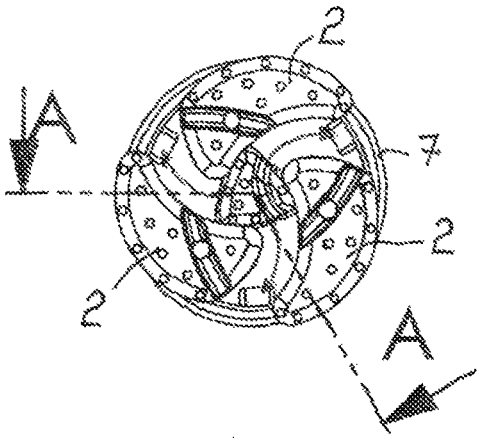
Figure 6:
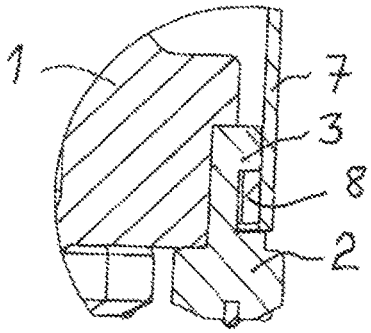
Figure 7:
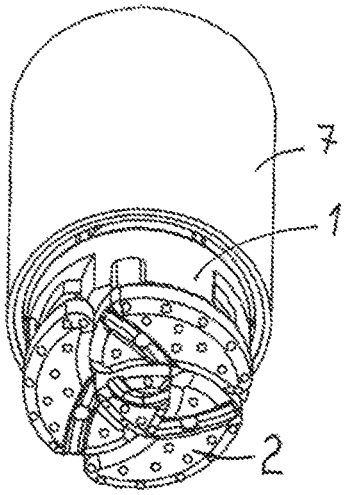
Figure 8:
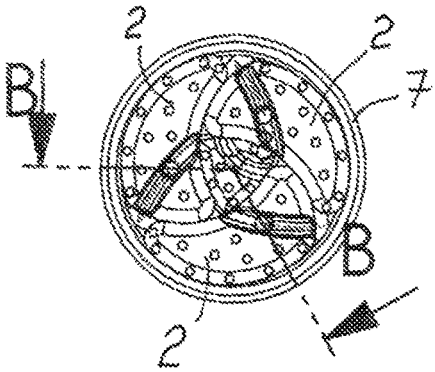
Figure 9:
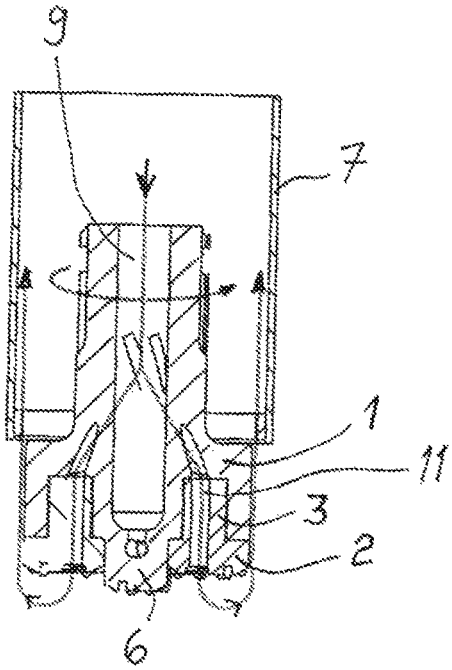
Figure 10:
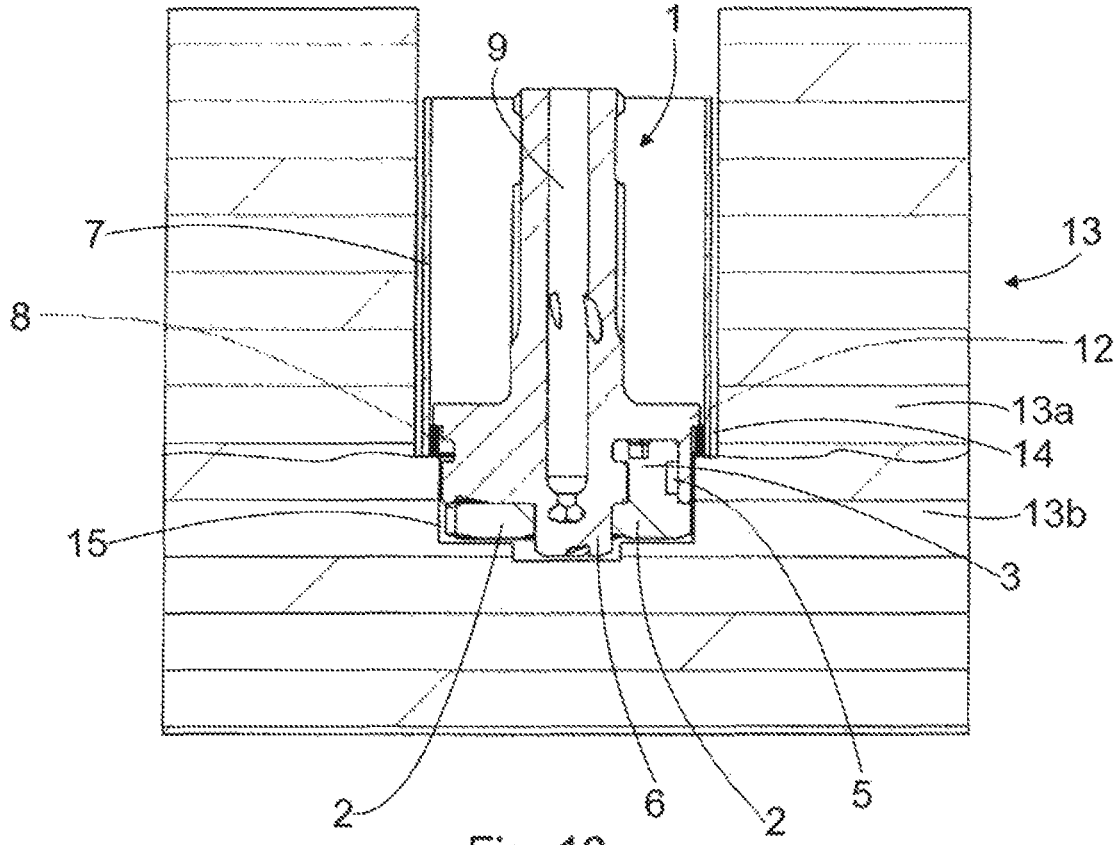

In the following, the invention will be described in closer detail and with reference to the accompanying drawing, in which FIG. 1 is an oblique view showing a drilling device with wing bits dislocated, FIG. 2 is a side view of the drilling device, FIG. 3 shows a protective pipe in connection with the drilling device and with the wing bits extended, FIG. 4 is a front view of the drilling device of FIG. 3, FIG. 5 is a sectional side view of the drilling device, FIG. 6 shows a detail of a front part of the protective pipe, FIG. 7 shows the drilling device with the wing bits retracted and exiting from the protective pipe, FIG. 8 is a front view of the drilling device of FIG. 7, FIG. 9 is a sectional view of the drilling device of FIG. 7, FIG. 10 is a cross-sectional side view showing another drilling device.

FIGS. 1 and 2 show a drilling device according to the invention, comprising a pilot bit 1 and wing bits 2. The pilot bit 1 includes a protruding bit part 6 drilling a centre of a hole, as well as cases 4 for bodies 3 of the wing bits 2. The bodies 3 of the wing bits 2 are allowed to rotate in said cases in a manner known per se. An outer circumference of the body 3 of the wing bits 2 is provided with circumferential grooves 5. The actual drilling section equipped with bit buttons protrudes in a lateral direction to an outer diameter dimension greater than a diameter formed by the bodies 3 of the wing bits 2.

FIG. 3 shows the wing bits 2 in an extended position. In other words, they have been rotated into a larger direction in the cases 4 of the pilot bit 1. The rotation of the wing bits is caused in a drilling situation by rotation of the drilling device into such a rotating direction that the wing bits 2 located eccentrically in relation to their bodies 3 start rotating outwards in their cases. In the outmost position, outer edges of the wing bits 2 exceed the outer diameter dimension of a protective pipe 7, which is shown in FIGS. 4, 5, and 6.

FIGS. 5 and 6 show the locking of the protective pipe 7 to the body 3 of the wing bits 2 by rotation of the pilot bit 1 in a direction of the arrow, the body 3 of the wing bits 2 rotating outwards from the case 4. The body 3 is adapted to be rotatable as much as is necessary for the groove 5 of the body 3 to reach a ring 8 in a front edge of the protective pipe 7 and for the ring 8 to settle in the groove 5. During drilling, the protective pipe 7 does not rotate, but the groove 5 is loose so as to enable the wing bit 2 to rotate and pull the protection pipe in.

FIG. 5 shows a course of a flushing flow from a central hole 9 all the way to a bit part 6 of the front part of the pilot bit, the flushing flow being discharged through openings 10 therein in the extended position of the wing bits 2 from intermediate spaces thereof onto the outer circumference of a drilling head and, therefrom, to the back and into the protective pipe. This occurs during ground drilling in particular while pulling the protective pipe along.

As is shown in FIG. 5, for instance, the central hole 9 is parallel with the axial direction of the drilling device.

However, the central hole 9 does not extend through the bit part 6. Instead, the sides of the bit part 6 are provided with openings 10. A channel formed by the opening 10 is thus perpendicular to the axial direction of the drilling device. Thus, the bit part 6 turns the axial flushing flow in the central hole 9 into a flushing flow transverse to the axial direction and flowing via the openings 10. Thus, the flushing flow does not remove too much soil in front of the frilling device. Further, the flushing flow is prevented from weakening the ground excessively. Further, the flushing flow transverse to the axial direction pressurizes the cases 4. This prevents soil and other impurities from collecting in the cases 4. This enables the wing bits 2, when desired, to rotate in the cases 4 back towards a smaller outer diameter dimension.

FIGS. 7, 8, and 9 show the rotating of the pilot bit 1 in a reverse direction, in which case the wing bits 2 start to rotate and retract towards a smaller outer diameter dimension. They are arranged to rotate to such an outer diameter dimension that together with the pilot bit 1 the wing bits may be pulled up from inside the protective pipe 7, regardless of the ring 8 decreasing the inner dimension.

FIG. 9 shows how, with the wing bits 2 pulled in/retracted, the drilling device may be moved through the protective pipe 7 in either direction. The protective pipe 7 is easy to detach in a borehole from the body 3 of the wing bits 2 merely by rotating the drilling device in a direction reverse to that employed while drilling. It is also possible to re-engage the protective pipe with the grooves 5 of the bodies 3 if the drilling device is occasionally lifted up from the rock hole and then lowered back into the hole. The drilling device then usually lowers to the exactly correct height position at which the locking takes place.

FIG. 9 shows a flushing flow arrangement while drilling with the wing bits 2 retracted. The flushing flow is delivered from the central hole 9 of the pilot bit 1 along drillings (shown by an arrow) formed inside the pilot bit 1 to the bottom of the cases 4 provided for the bodies 3 of the wing bits 2, wherefrom the flushing flows run via openings 11 through the wing bits 2 to the surface of the wing bits 2 and further to the outer circumference of the drilling head. The openings 11 of the wing bits 2 meet the drillings coming via the pilot bit 1, and the wing bits 2, in turn, close the flow openings 10 opening from the bit part 6 towards the wing bits 2 (FIG. 2).

The openings 11 through the wing bits 2 open up to the front surface of the wing bits 2. The flushing flow, while flowing through the openings 11, is thus directed forward in the axial direction of the drilling device. The drilling situation according to FIG. 9 may occur for instance when first a protective pipe has been drilled to a desired depth and, subsequently, a smaller hole is drilled without a protective pipe. Such a smaller hole may be drilled in a rock, for instance. In such a case, it is advantageous that the axial flushing flow removes loose rock material in front of the drilling device.

When drilling with the drilling device with the wing bit 2 in the extended position, a hole having a diameter sized as at least the protective pipe 7 is being drilled. Thus, at the same time, the grooves 5 in the body 3 of the wing bits 2 are used for pulling the protective pipe 7 along with the drilling device. In such a case, the drilling section of the wing bits 2 equipped with bit buttons extends slightly longer than the protective pipe 7, as is illustratively shown in FIG. 5, for instance. In some cases, then, it may happen that when the wing bits are rotated in to the retracted position and the drilling device is lifted out of the protective pipe 7, the protective pipe 7 does not reach the bottom of the hole drilled with the wing bits 2 in the extended position. This problem can be solved by the drilling device according to FIG. 10.

The solution according to FIG. 10 mainly corresponds to the drilling device shown in FIGS. 1 to 9, but in the solution according to FIG. 10 the pilot bit 1 is provided with a shoulder 12. Initial stages of the drilling are carried out as in connection with the drilling device according to FIG. 1 to 9. This, then, comprises drilling in the ground 13 a hole having at least the size of the protective pipe 7, i.e. a hole 14 having a greater diameter, such that the wing bits 2 are in an extended position, and receiving by the groove 5 the ring 8 of the protective pipe 7 and pulling by means of the wing bits 2 the protective pipe 7 into the hole 14 of the greater diameter. Such a hole 14 with the greater diameter is drilled in a softer part 13*a* in the ground 13. Upon reaching a harder part 13*b* in the ground 13, for instance a rock, the wing bits 2 are arranged in a retracted position and a hole 15 with a smaller diameter is drilled in the harder part 13*b* in the ground 13. The outer dimension of the shoulder 12 is greater than the inner dimension of the ring 8 of the protective pipe. Thus, while drilling the hole 15 with the smaller diameter a sufficiently long distance, the shoulder 12 will hit the ring 8 of the protective pipe 7 and start carrying the protective pipe 7 along therewith. This enables the protective pipe 7 to be reliably moved towards the bottom of the hole 14 with the greater diameter. If the hole 15 with the smaller diameter is drilled a sufficient distance, the shoulder 12 enables the protective pipe 7 to be pushed all the way to the bottom of the hole 14 with the greater diameter. This enables, when desired, the protective pipe 7 to be reliably brought against the harder part 13*b* in the ground 13.

The invention claimed is:

1. A drilling device for drilling a hole in ground and/or rock and comprising: a drilling head having a plurality of drilling wing bits arranged at equal distribution with their mutual position being adjustable such that said wing bits are located within a first diameter dimension and, on the other hand, adjustable such that they are located to drill a hole with a second larger diameter dimension and that the drilling device is configured to pull, during drilling, a protective pipe into a hole at least when drilling the hole in ground, wherein an outer circumference of each of said wing bits includes a circumferential groove configured and arranged to receive a ring belonging to a front part of the protective pipe, to an inner surface thereof, when said wing bits are adjusted to a diameter size substantially larger than the first diameter dimension in order to pull the protective pipe via said wing bits.

2. The drilling device as claimed in claim 1, wherein when drilling a hole with the larger diameter dimension, a drilling outer edge of the wing bit is located farther out than an outer diameter of the protective pipe.

3. The drilling device as claimed in claim 2, wherein the wing bits are configured to move towards a smaller diameter dimension by rotation of the drilling head in a first direction and, correspondingly, to move towards a greater diameter dimension by rotation of the drilling head to a second direction.

4. The drilling device as claimed in claim 3, wherein the drilling device comprises:

a pilot bit provided with cases for the wing bits, and wherein the drilling device is configured to enable drilling both with the wing bits in an extended position and with the wing bits in a retracted position, the retracted position being configured for a flushing flow delivered to a bottom of the cases located in the pilot bit and therefrom, via a drilling located in the wing bit, to a front side of the wing bits.

5. The drilling device as claimed in claim 4, wherein the pilot bit is comprises:

a bit part for drilling a centre of the hole, the bit part being provided with flow openings for a flushing flow, and in the retracted position, the wing bits are configured to close the flow openings coming via the bit part to a drilling tip.

6. The drilling device as claimed in claim 5, wherein the number of wing bits is at least two, and the wing bits being configured such that while adjusting their position, they rotate in their case with a rotation axis being parallel with a drilling direction.

7. The drilling device as claimed in claim 6, wherein when adjusted to the first diameter size, the wing bits and the drilling head are pullable/pushable through the protective pipe in either direction.

8. The drilling device as claimed in claim 7, wherein the drilling device comprises:

a pilot bit provided with a shoulder whose outer dimension is greater than an inner dimension of the ring of the protective pipe.

9. The drilling device as claimed in claim 1, wherein the wing bits are configured to move towards a smaller diameter dimension by rotation of the drilling head in a first direction and, correspondingly, to move towards a greater diameter dimension by rotation of the drilling head to a second direction.

10. The drilling device as claimed in claim 1, wherein the drilling device comprises:

a pilot bit provided with cases for the wing bits, and wherein the drilling device is configured to enable drilling both with the wing bits in an extended position and with the wing bits in a retracted position, the retracted position being configured for a flushing flow delivered to a bottom of the cases located in the pilot bit and therefrom, via a drilling located in the wing bit, to a front side of the wing bits.

11. The drilling device as claimed in claim 10, wherein the pilot bit comprises:

a bit part for drilling a centre of the hole, the bit part being provided with flow openings for a flushing flow, and in the retracted position, the wing bits are configured to close the flow openings coming via the bit part to a drilling tip.

12. The drilling device as claimed in claim 1, wherein the number of wing bits is at least two, and the wing bits being configured such that while adjusting their position, they rotate in their case with a rotation axis being parallel with a drilling direction.

13. The drilling device as claimed in claim 1, wherein when adjusted to the first diameter size, the wing bits and the drilling head are pullable/pushable through the protective pipe in either direction.

14. The drilling device as claimed in claim 1, wherein the drilling device comprises:

a pilot bit provided with a shoulder whose outer dimension is greater than an inner dimension of the ring of the protective pipe.

* * * * *